US006345566B1

(12) United States Patent
Stevens

(10) Patent No.: US 6,345,566 B1
(45) Date of Patent: Feb. 12, 2002

(54) HYDRAULIC MASTER CYLINDER WITH INTEGRAL SWITCH STRUCTURE

(75) Inventor: Bryan M. Stevens, Clinton Township, MI (US)

(73) Assignee: Automotive Products (USA), Inc.

( * ) Notice: Subject to any disclaimer, the term of this patent is extended or adjusted under 35 U.S.C. 154(b) by 0 days.

(21) Appl. No.: 09/619,837

(22) Filed: Jul. 20, 2000

(51) Int. Cl.[7] ..... F01B 25/26
(52) U.S. Cl. ..... 92/5 R; 200/61.89
(58) Field of Search ..... 60/534; 92/5 R; 200/61.89

(56) References Cited

U.S. PATENT DOCUMENTS

| | | | | |
|---|---|---|---|---|
| 3,015,001 A | | 12/1961 | Woofter | 200/16 |
| 4,239,947 A | | 12/1980 | Breitung et al. | 200/61.89 |
| 4,354,069 A | | 10/1982 | Ragen | 200/243 |
| 4,621,565 A | | 11/1986 | Leigh-Monstevens | 92/5 R |
| 4,649,238 A | | 3/1987 | Beck et al. | 200/303 |
| 4,719,444 A | | 1/1988 | Leigh -Monstevens et al. | 200/61.89 |
| 4,742,193 A | | 5/1988 | Kassin et al. | 200/61.89 |
| 4,878,041 A | | 10/1989 | Leigh-Monstevens et al. | 200/61.89 |
| 4,911,276 A | * | 3/1990 | Leigh -Monstevens et al. | 60/534 |
| 5,343,005 A | | 8/1994 | Salzmann | 200/61.89 |
| 6,000,516 A | * | 12/1999 | Teichert et al. | 92/128 |
| 6,250,203 B1 | * | 6/2001 | Mischler et al. | 92/5 R |

* cited by examiner

*Primary Examiner*—Edward K. Look
*Assistant Examiner*—Thomas E Lazo
(74) *Attorney, Agent, or Firm*—Young & Basile

(57) ABSTRACT

A master cylinder assembly for controlling a motor vehicle clutch including switches for controlling functions such as enabling the starter motor, disabling the cruise control, or signaling the engine computer. The assembly includes an annular seal disposed in an internal groove in the wall of the cylinder sealingly engaging the piston of the cylinder and dividing the cylinder into a pressurized chamber on one side of the seal and an unpressurized chamber open to atmosphere on the other side of the seal. The plurality of axially spaced pairs of contacts are provided on the inner wall of the cylinder in the unpressurized chamber for coaction with an annular contact carried by a flange structure defined by the piston so that as the piston moves axially within the cylinder in response to depression of the clutch the annular contact on the piston successively closes circuits associated with the successive spaced pairs of contacts on the inner wall of the cylinder whereby to successively enable or disable motor vehicle control devices associated with the pairs of cylinder contacts.

18 Claims, 3 Drawing Sheets

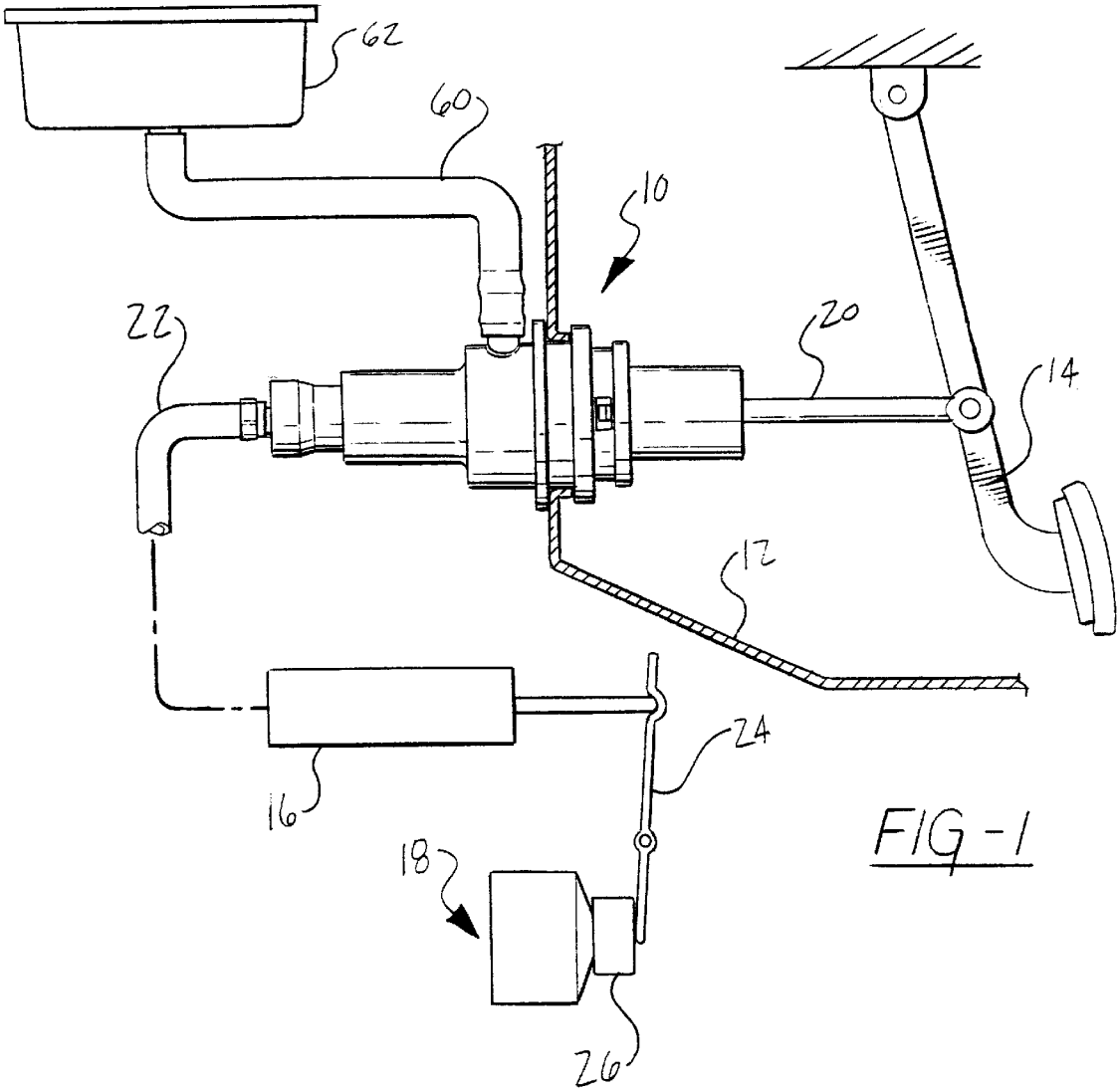
FIG-1
FIG-5
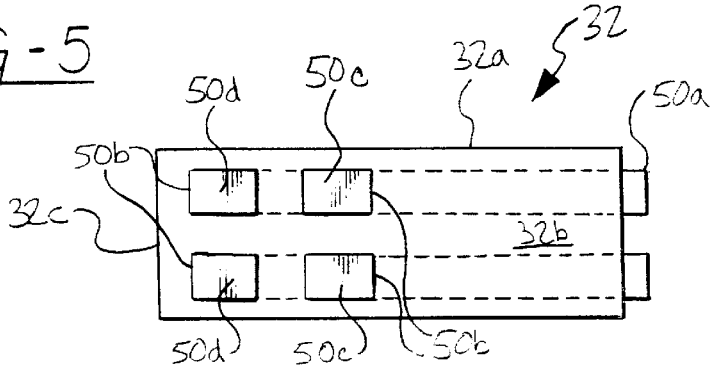

HYDRAULIC MASTER CYLINDER WITH INTEGRAL SWITCH STRUCTURE

BACKGROUND OF THE INVENTION

This invention relates to hydraulic master cylinder assemblies and more particularly to a hydraulic master cylinder assembly incorporating switching functions.

It has become general practice in the automobile industry to interlock the operation of the engine starter motor with other controls of the motor vehicle such that the starter motor is rendered inoperative unless the transmission is in neutral or park in motor vehicles provided with an automatic transmission or, in motor vehicles provided with a foot operated clutch and a manually operated gear shift transmission, unless the transmission is in neutral and/or the clutch pedal is fully depressed to fully release the clutch. In addition, it is convenient in a motor vehicle provided with a cruise control and a mechanical clutch to shut off the operation of the cruise control upon, for example, downshifting which in turn requires release of the clutch. Specifically, it is necessary that the cruise control be disconnected even before the clutch is fully released to enable the driver to cut out the cruise control by a slight foot tap on the clutch pedal. It is also desirable, upon clutch disengagement, to generate a signal for transmission to the engine computer indicating that the torque path is going to be disengaged so that the computer may take appropriate action such as shutting down the fuel injection or reducing the fuel injection.

Many arrangements have been provided for providing switching functions in association with the master cylinder assembly to accomplish the various desired switching operations as the clutch pedal is depressed. Examples of such switches are shown for example in U.S. Pat. Nos. 4,878,041; 4,719,444; 4,742,193; 4,649,238; and 5,343,005. The switch devices shown in these prior art patents are all of the type in which the switch mounts on the push rod of the master cylinder assembly and in which the switch includes a plurality of axially spaced switches which can be sequentially actuated in response to depression of the clutch to generate a sequential series of control signals with respect to cruise control, starter interlock, fuel injection control, etc. Whereas these prior art switches have proven to be generally satisfactory, generating the required control signals in response to depression of the clutch, the use of a separate switch module on the push rod of the master cylinder adds significantly to the overall cost and complexity of the master cylinder assembly and the sequential arrangement of the various switches along the length of the switch module results in a relatively long switch assembly which is incapatible with the relatively short push rods that are found in many present day motor vehicles.

SUMMARY OF THE INVENTION

This invention is directed to the provision of an improved switching arrangement for a master cylinder assembly.

More specifically, this invention is directed to the provision of a master cylinder assembly in which the switching functions are provided integral with the master cylinder assembly.

The invention is applicable to a pressure cylinder apparatus of the type including a hydraulic cylinder structure having a cylindrical wall defining a generally closed left end and a generally open right end; a piston movable axially within the hollow of the cylinder structure; a seal structure between the piston and the cylinder structure defining a fluid pressure chamber within the cylinder on the left side of the piston and an unpressurized chamber on the right side of the piston; a fluid pressure fitting communicating with the pressure chamber for connection to a fluid pressure conduit communicating with a coacting fluid pressure device; and a piston rod extending through the open end of the cylinder and into the unpressurized chamber for connection to the right side of the piston.

According to the invention, a contact is carried by the piston at a location on the piston to the right of the seal structure and within the unpressurized chamber; a contact is disposed at an interior surface of the cylinder within the unpressurized chamber for selective coaction with the piston contact in response to axial movement of the piston in the hollow of the cylinder; and an electrical lead is connected to one of the contacts and extends to a location external to the cylinder for providing an electrical control signal generated in response to closing of the cylinder contact by the piston contact. This switching arrangement provides a switching function required in association with a typical pressure cylinder apparatus while reducing the overall cost and complexity of the total pressure cylinder apparatus and minimizing the overall size of the total pressure cylinder apparatus.

According to a further feature of the invention, a plurality of axially spaced contacts are disposed at the interior surface of the cylinder within the unpressurized chamber for selective coaction with the piston contact in response to axial movement of the piston in the hollow of the cylinder, and a plurality of electrical leads are connected to the respective cylinder contacts and extend to locations external to the cylinder for providing respective electrical control signals generated in response to selective closing of the cylinder contacts by the piston contact. This switching arrangement provides all of the switching functions required in association with a typical pressure cylinder apparatus while reducing the overall cost and complexity of the total pressure cylinder apparatus and minimizing the overall size of the total pressure cylinder apparatus.

According to a further feature of the invention, the seal structure comprises an annular elastomeric seal positioned in an annular groove provided in the interior surface of the cylinder and arranged for wiping engagement with an exterior surface of the piston as the piston moves axially in the cylinder. This arrangement maximizes the length of the unpressurized chamber in which the cylinder contacts are disposed.

According to a further feature of the invention, the cylinder is a compound structure constituted by a left cylinder structure defining the pressure chamber and a right cylinder structure coupled to the left cylinder structure and carrying the plurality of axially spaced cylinder contacts. This arrangement allows the switching functions of the apparatus to be embodied in a separate module for inventory and quality control purposes.

According to a further feature of the invention, the right cylinder structure is a compound structure constituted by a cartridge and a right cylinder member having a cylindrical wall having an open right end and including an axially extending slot opening into the hollow interior of the right cylinder and opening at the right end of the right cylinder; the cartridge is sized to fit in the slot; the axially spaced cylinder contacts are provided on an inner surface of the cartridge; and the electrical leads are carried by the cartridge. This specific arrangement allows the switching functions of the apparatus to be totally isolated from the remainder of the apparatus for inventory and quality control purposes.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is a partial schematic view of a motor vehicle incorporating a master cylinder apparatus according to the invention;

FIG. 5 is a bottom detail view of a switch cartridge embodied in the master cylinder apparatus.

DESCRIPTION OF THE PREFERRED EMBODIMENT

Figure 3:
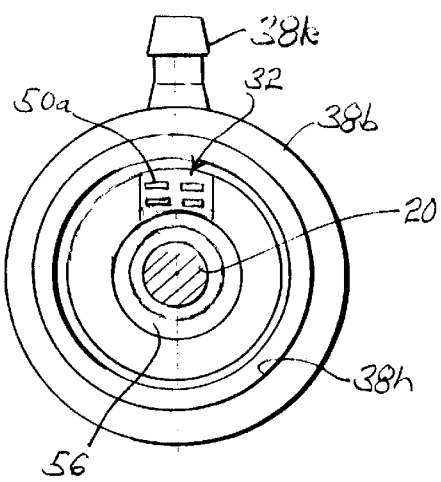
FIG. 3 is a cross-sectional view taken on line 3—3 of FIG. 2.

The invention master cylinder apparatus 10 is seen in FIG. 1 in association with a motor vehicle of the type including a firewall 12, a clutch pedal 14, a slave cylinder 16, and a clutch 18. The master cylinder 10 is fixedly secured to firewall 12 in known manner and clutch pedal 14 is pivotally secured to the free end of the push rod 20 of the master cylinder so that depression of the clutch pedal 14 by a vehicle operator transmits pressurized hydraulic fluid through a conduit 22 to slave cylinder 16 which operates a release lever 24 which acts upon a clutch release bearing 26 to disengage the clutch 18 in known manner.

Master cylinder 10 (FIGS. 2 and 3) includes a cylinder structure 28, a seal assembly 30, a cartridge 32, push rod 20, a piston assembly 34, and a reservoir 36.

Figure 2:
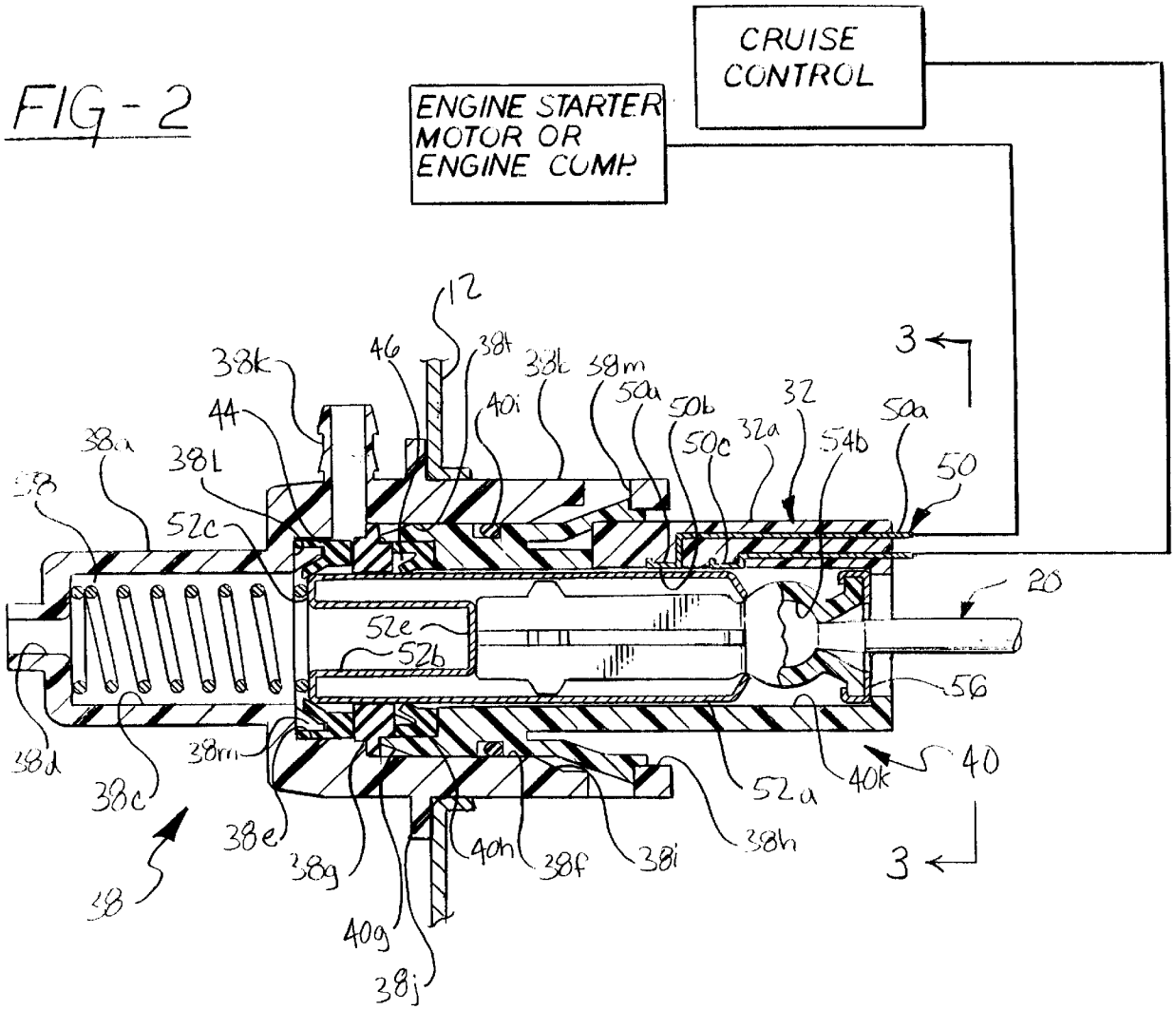
FIG. 2 is a cross-sectional view of the master cylinder apparatus.

The designations left and right as hereinafter employed are with respect to FIG. 2 and the designations forwardly and rearwardly as hereinafter employed designate leftward and rightward movement, respectively, as viewed in FIG. 2.

Cylinder structure 28 includes a left cylinder structure 38 and a right cylinder structure 40. The cylinder structures are shown in their coupled relationship in FIG. 2 and in an exploded relationship in FIG. 3.

Left cylinder structure 38 includes a left relatively small diameter portion 38*a* and a right relatively large diameter portion 38*b*. Left portion 38*a* defines a bore 38*c* and a fluid pressure outlet 38*d*. Right portion 38*b* defines a bore 38*e*, a counter bore 38*f*, a conical bore 38*g* interconnecting bores 38*e* and 38*f*, a further counter bore 38*h*, a conical bore 38*i* interconnecting bores 38*f* and 38*h*, an external mounting flange 38*j*, a reservoir fitting 38*k*, and an annular shoulder 38*l* interconnecting bores 38*c* and 38*e*.

Right cylinder member 40 includes a main body tubular portion 40*a* including an axially extending slot 40*b* opening at the right face 40*c* of the main body tubular portion, an enlarged diameter flange portion 40*d* joined to main body portion 40*a* by an annular shoulder 40*e*, and circumferentially spaced finger portions 40*f* extending rearwardly from flange portion 40*e* in radially spaced relation to main body portion 40*a*. The left portion of flange portion 40*d* has an angled exterior surface 40*g* defining an annular interior groove 40*h*. Flange portion 40*d* further defines an annular external groove 40*i* for receipt of an elastomeric O-ring 42. Right cylinder member 40 is fitted telescopically into left cylinder member 38 with flange portion 40*d* slidably received in bore 38*f*, O-ring 42 sealingly engaging bore 38*f*, and nubs 40*n* carried by the free ends 40*j* of fingers 40*f* snappingly received in respective arcuate slots 38*m* in portion 38*b* to preclude inadvertent withdrawal of part 40 from part 38.

Seal assembly 30 includes a primary annular elastomeric seal 44, a secondary annular elastomeric seal 46, and an annular spacer 48. Primary seal 44 is received in an annular groove 38*m* defined between shoulder 38*l* and bore 38*e*, secondary seal 46 is received in annular groove 40*h*, and annular spacer 48 is positioned between the primary and secondary seals proximate conical bore 38*g*.

Figure 4:
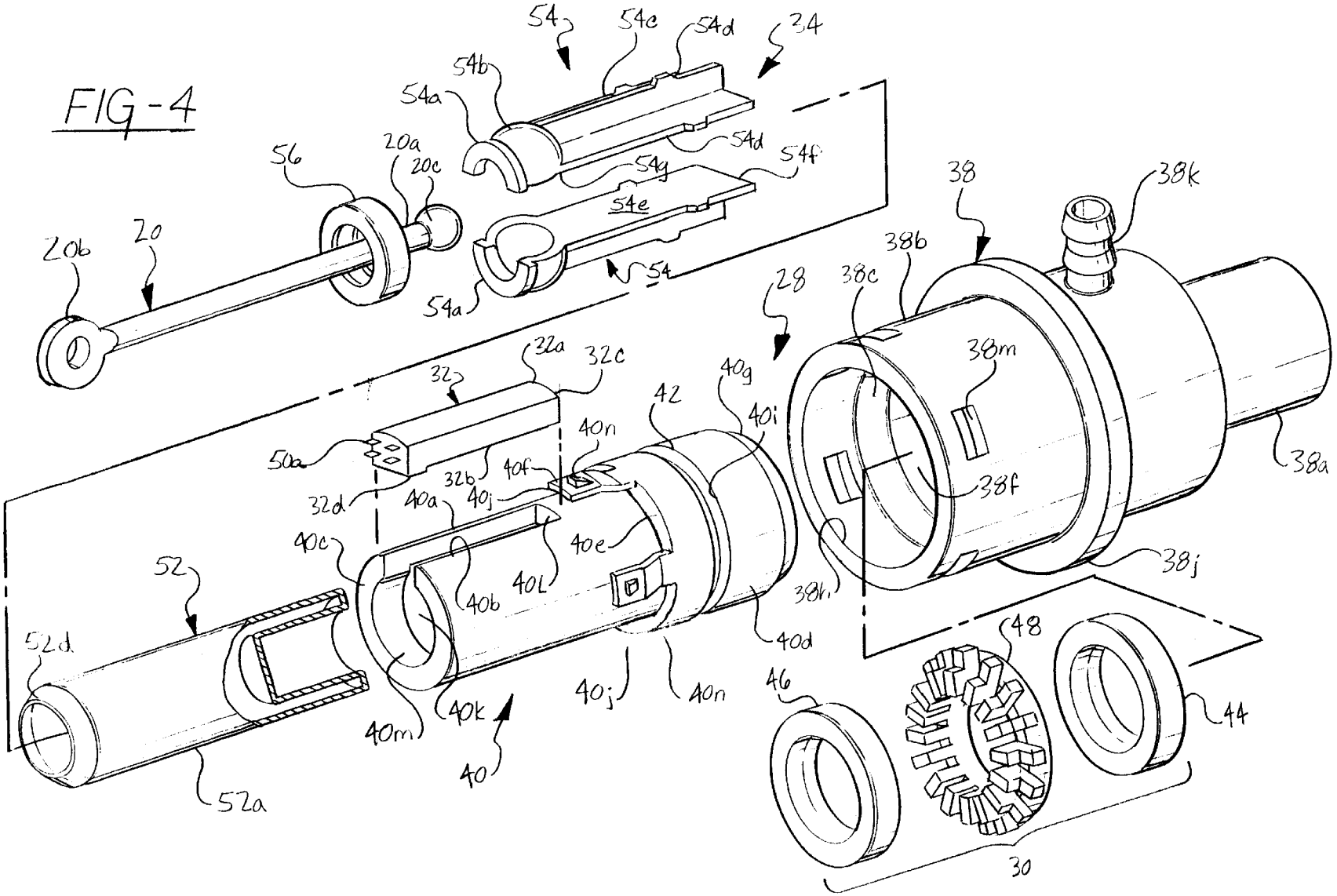
FIG. 4 is a perspective exploded view of the master cylinder apparatus.

Cartridge 32 (see also FIG. 4) includes a main body portion 32*a* formed of a suitable insulative material and a plurality of conductors or leads 50 embedded in main body portion 32*a* and formed of a suitable conductive material. Main body portion 32*a* is sized to fit in slot 40*b* and has an arcuate cross-sectional configuration conforming to the radius of cylinder main body portion 40*a* so as to, when fitted into slot 40*b*, form a continuation of the arcuate circumferential curve of main body portion 40*a*. When fitted into slot 40*b* the inner arcuate surface 32*b* of the main body portion is flush with bore 40*k* of cylinder main body portion 40*a*, the left end 30*c* of the main body portion is seated against the end 40*l* of slot 40*b* and telescopically positioned in cylinder bore 38*h*, and the main body portion is positioned circumferentially between circumferentially spaced finger portions 40*f*. Leads 50 extend axially through main body portion 32*a* and define terminal ends 50*a* for connection to external leads and contacts 50*b* positioned in exposed relation flush with the inner surface 32*b* of the main body portion.

A plurality of pairs of leads are provided. For example, and as shown, two pairs of leads are provided with the first pair of leads terminating in a pair of circumferentially spaced contacts 50*c* and the second pair of leads terminating in a pair of circumferentially spaced contacts 50*d* spaced axially from contacts 50*c*.

Push rod 20 includes a main body shaft portion 20*a*, a swivel portion 20*b* for pivotal connection to clutch pedal 14, and a spherical ball end portion 20*c*.

Piston assembly 34 includes a piston member 52, a pair of insert halves 54, and a piston contact 56.

Piston member 52 is formed of a suitable sheet metal material and includes a main body outer shell portion 52*a*, an inner tubular portion 52*b* positioned concentrically within the left end of outer shell portion 52*a* and joined to the left end of shell portion 52*a* by annular shoulder 52*c*, and an inwardly directed flange portion 52*d* at the right end of outer shell portion 52*a*. Piston 52 is sized to fit slidably within bore 40*k* and to sealingly engage at its left end with the inner lip seal portions of primary seal 44 and secondary seal 46.

Each insert half 54 is formed of a suitable plastic material in a suitable molding operation and includes a right end flange portion 54*a*, a hemispherical portion 54*b* adjoining flange portion 54*a*, and a main body portion 54*c* extending rearwardly from hemispherical portion 54*b* and defined by a plurality of circumferentially spaced ribs 54*d* and a flat inner face 54*e*.

In the assembled relation of the piston assembly, insert halves 54 are received within piston member 52 with nubs 54*e* on the ribs 54*d* engaging the inner piston member walls, the left end 54*f* of the insert halves bearing against the blind end 52*e* of the inner tubular portion 52*b* of the piston member, and the flange 52*d* of the piston member crimped over the ends 54*g* of the ribs 54*d* to firmly lock the piston member over the main body portions of the insert halves. The spherical portions 54*b* and the flange portions 54*a* of the insert halves project forwardly out of the piston member to define a spherical cavity 54*h* and an annular flange constituted by the fitted together flange halves 54*a* of the upper and lower insert halves.

Contact 56 has an annular configuration, is formed of a suitable conductive material, and is fitted over flanges 54*a* in crimping fashion so as to be fixedly mounted on flanges 54*a*.

In the assembled relation of the piston assembly and the push rod, the ball end 20*c* of the push rod is received in spherical cavity 54*h* and the main body 20*a* of the push rod extends through the open right-hand end of right cylinder member 40.

In the assembled relation of the master cylinder, it will be seen that the piston assembly and the seals coact to define a hydraulic fluid pressure chamber within the bore 38*c* on the left side of the piston and a dry unpressurized atmospheric chamber within the bore 40*k* on the right side of the piston, and it will further be seen that the contact pairs 50*c*/50*d* as well as the annular contact 56 are positioned in the dry, unpressurized chamber defined within the bore 40*k*. It further will be understood that fitting 38*k* is connected by a conduit, such as conduit 60 seen in FIG. 1, to an external hydraulic fluid reservoir 62 whereby to deliver hydraulic fluid to the cylinder apparatus and it will be further understood that seal assembly 30 acts in known manner to allow the delivery of hydraulic fluid to the pressure chamber within the bore 38*c* on the left side of the piston assembly while precluding delivery of hydraulic fluid to the unpressurized chamber within the bore 40*k*.

In operation, the clutch pedal is depressed to move the piston assembly to the left to eject hydraulic fluid under pressure through fitting 38*d* for delivery to a coacting fluid pressure device such as the slave cylinder 16 controlling the clutch 18 and, upon release of the clutch pedal, the piston assembly is returned to the right under the action of a return spring 58 with hydraulic fluid flowing from the reservoir through the conduit 60 and fitting 38*k* and past the collapsed primary seal 44 to fill in the chamber 38*c* behind the retreating piston assembly. The rightward, return movement of the piston is defined by engagement of contact 56 with an annular lip 40*m* on the right end of cylinder member 40 and a coacting annular lip 32*d* on the right end of cartridge 32.

As the piston assembly moves forwardly within the cylinder structure, annular contact 56 first engages the contacts 50*c* to electrically span the circumferential space between the contacts and complete a circuit through the two leads 50 defining the spaced contacts 50*c* whereby to transmit a control signal to an associated cruise control device to disengage the cruise control whereafter, with further leftward movement of the piston assembly in response to further depression of the clutch pedal, contact 56 electrically spans the circumferential space between the contacts 50*d* to complete an electrical circuit through the two leads 50 defining the contacts 50*d* and thereby generate an electrical control signal for transmittal, for example, to the engine starter motor to enable starting of the engine and/or to the engine computer for appropriate action consistent with disengagement of the engine torque path.

The invention will be seen to provide a master cylinder assembly in which the switching functions are provided integral with the master cylinder assembly whereby to minimize the overall cost and complexity of the master cylinder and switch assembly and whereby to eliminate the space problems associated with the separate switch assembly positioned on the push rod of the master cylinder assembly.

While the invention has been described in connection with what is presently considered to be the most practical and preferred embodiment, it is to be understood that the invention is not to be limited to the disclosed embodiment but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A pressure cylinder apparatus comprising:

a hydraulic cylinder structure having a cylindrical wall defining a generally closed left end and a generally open right end;

a piston movable axially within the hollow of the cylinder structure;

a seal structure between the piston and the cylinder structure defining a fluid pressure chamber within the cylinder structure on the left side of the piston and an unpressurized chamber on the right side of the piston;

a fluid pressure fitting communicating with the pressure chamber for connection to a fluid pressure conduit communicating with a coacting fluid pressure device;

a piston rod extending through the open end of the cylinder structure and into the unpressurized chamber for connection to the right side of the piston;

a piston contact carried by and fixedly secured to the piston at a location on the piston to the right of the seal structure and within the unpressurized chamber;

a cylinder contact disposed at an interior surface of the cylinder structure within the unpressurized chamber for coaction with the piston contact in response to axial movement of the piston in the hollow of the cylinder structure; and an electrical lead connected to one of the piston and cylinder contacts and extending to a location external to the cylinder apparatus for providing an electrical control signal generated in response to engagement of the cylinder contact with the piston contact.

2. A pressure cylinder apparatus according to claim 1 wherein the seal structure is carried by the cylinder structure.

3. A pressure cylinder apparatus according to claim 2 wherein the seal structure comprises an annular elastomeric seal positioned in an annular groove provided in the interior surface of the cylinder structure and arranged for wiping engagement with an exterior surface of the piston as the piston moves axially in the cylinder structure.

4. A pressure cylinder apparatus according to claim 1 wherein the cylinder structure is a compound structure constituted by a left cylinder structure defining the pressure chamber and a right cylinder structure coupled to the left cylinder structure and carrying the cylinder contact.

5. A pressure cylinder apparatus comprising:

a hydraulic cylinder structure having a cylindrical wall defining a generally closed left end and a generally open right end;

a piston movable axially within the hollow of the cylinder structure;

a seal structure between the piston and the cylinder structure defining a fluid pressure chamber within the cylinder structure on the left side of the piston and an unpressurized chamber on the right side of the piston;

a fluid pressure fitting communicating with the pressure chamber for connection to a fluid pressure conduit communicating with a coacting fluid pressure device;

a piston rod extending through the open end of the cylinder structure and into the unpressurized chamber for connection to the right side of the piston;

a piston contact carried by the piston at a location on the piston to the right of the seal structure and within the unpressurized chamber;

a cylinder contact disposed at an interior surface of the cylinder structure within the unpressurized chamber for coaction with the piston contact in response to axial movement of the piston in the hollow of the cylinder structure; and an electrical lead connected to one of the piston and cylinder contacts and extending to a location external to the cylinder apparatus for providing an electrical control signal generated in response to engagement of the cylinder contact with the piston contact;

the cylinder structure comprising a compound structure constituted by a left cylinder structure defining the pressure chamber and a right cylinder structure coupled to the left cylinder structure and carrying the cylinder contact;

the right cylinder structure comprising a compound structure constituted by a cartridge and a right cylinder member having a cylindrical wall having an open right end and including a axially extending slot opening into the hollow interior of the right cylinder member and opening at the right end of the right cylinder member;

the cartridge being sized to fit in the slot;

the cylinder contact being provided on an inner surface of the cartridge; and the electrical lead being carried by the cartridge and connecting to the cylinder contact.

6. A pressure cylinder apparatus comprising:

a hydraulic cylinder structure having a cylindrical wall defining a generally closed left end and a generally open right end;

a piston movable axially within the hollow of the cylinder structure;

a seal structure between the piston and the cylinder structure defining a fluid pressure chamber within the cylinder structure on the left side of the piston and an unpressurized chamber on the right side of the piston;

a fluid pressure fitting communicating with the pressure chamber for connection to a fluid pressure conduit communicating with a coacting fluid pressure device;

a piston rod extending through the open end of the cylinder structure and into the unpressurized chamber for connection to the right side of the piston;

a piston contact carried by an fixedly secured to the piston at a location on the piston to the right of the seal structure and within the unpressurized chamber;

a plurality of axially spaced cylinder contacts disposed at an interior surface of the cylinder structure within the unpressurized chamber for selective coaction with the piston contact in response to axial movement of the piston in the hollow of the cylinder structure; and a plurality of electrical leads connected to the respective cylinder contacts and extending to locations external to the cylinder structure for providing respective electrical control signals generated in response to selective closing of the cylinder contacts by the piston contact.

7. A pressure cylinder apparatus according to claim 6 wherein the seal structure is carried by the cylinder structure.

8. A pressure cylinder apparatus according to claim 7 wherein the seal structure comprises an annular elastomeric seal positioned in an annular groove provided in the interior surface of the cylinder structure and arranged for wiping engagement with an exterior surface of the piston as the piston moves axially in the cylinder.

9. A pressure cylinder apparatus according to claim 6 wherein the cylinder structure is a compound structure constituted by a left cylinder structure defining the pressure chamber and a right cylinder structure coupled to the left cylinder structure and carrying the plurality of axially spaced cylinder contacts.

10. A pressure cylinder apparatus comprising:

a hydraulic cylinder structure having a cylindrical wall defining a generally closed left end and a generally open right end;

a piston movable axially within the hollow of the cylinder structure;

a seal structure between the piston and the cylinder structure defining a fluid pressure chamber within the cylinder structure on the left side of the piston and an unpressurized chamber on the right side of the piston;

a fluid pressure fitting communicating with the pressure chamber for connection to a fluid pressure conduit communicating with a coacting fluid pressure device;

a piston rod extending through the open end of the cylinder structure and into the unpressurized chamber for connection to the right side of the piston;

a piston contact carried by the piston at a location on the piston to the right of the seal structure and within the unpressurized chamber;

a plurality of axially spaced cylinder contacts disposed at an interior surface of the cylinder structure within the unpressurized chamber for selective coaction with the piston contact in response to axial movement of the piston in the hollow of the cylinder structure; and a plurality of electrical leads connected to the respective cylinder contacts and extending to locations external to the cylinder structure for providing respective electrical control signals generated in response to selective closing of the cylinder contacts by the piston contact;

the cylinder structure comprising a compound structure constituted by a left cylinder structure defining the pressure chamber and a right cylinder structure coupled to the left cylinder structure and carrying the plurality of axially spaced cylinder contacts;

the right cylinder structure comprising a compound structure constituted by a cartridge and a right cylinder member having a cylindrical wall having an open right end and including an axially extending slot opening into the hollow interior of the right cylinder member and opening and the right end of the right cylinder member;

the cartridge being sized to fit in the slot;

the axially spaced cylinder contacts being provided on a interior surface of the cartridge; and the electrical leads being carried by the cartridge.

11. A pressure cylinder apparatus comprising:

a hydraulic cylinder structure having a cylindrical wall defining a generally closed left end, a generally open right end, and an axially extending slot opening into the hollow interior of the cylinder proximate the right cylinder end;

a piston movable axially within the hollow of the cylinder structure;

a seal structure between the piston and the cylinder structure defining a fluid pressure chamber within the cylinder structure on the left side of the piston and an unpressurized chamber on the right side of the piston;

a fluid pressure fitting communicating with the pressure chamber for connection to a fluid pressure conduit communicating with a coacting fluid pressure device;

a piston rod extending through the open right end of the cylinder structure and into the unpressurized chamber for connection to the right side of the piston;

a contact carried by the piston at a location on the piston to the right of the seal structure and within the unpressurized chamber; and a cartridge assembly including a cartridge body received in the slot and a plurality of leads extending through the cartridge body and terminating in a plurality of axially spaced contacts disposed at an interior surface of the cartridge body confronting the hollow of the cylinder structure within the unpressurized chamber for selective coaction with the piston contact.

12. A pressure cylinder apparatus according to claim 11 wherein the seal structure is carried by the cylinder structure.

13. A pressure cylinder apparatus according to claim 12 wherein the seal structure comprises an annular elastomeric seal positioned in an annular groove provided in the interior surface of the cylinder structure and arranged for wiping engagement with an exterior surface of the piston as the piston moves axially in the cylinder structure.

14. A pressure cylinder apparatus according to claim 11 wherein:

the cylinder structure is a compound structure constituted by a left cylinder structure defining the pressure chamber and a right cylinder structure coupled to the left cylinder structure;

the cartridge forms a part of the right cylinder structure; and the right cylinder structure further includes a right cylinder member defining the slot in which the cartridge is received.

15. A pressure cylinder apparatus comprising:

a hydraulic cylinder assembly including a left cylinder member, having a generally closed left end and defining a rightwardly opening socket at its right end, and a right cylinder member telescopically received at a left end thereof in the socket of the left cylinder member, coacting at its left end with the left cylinder member to define an annular inwardly opening groove, and defining a bore;

an annular seal received in the annular groove;

a piston slidably received in the right cylinder member bore and wipingly engaging the annular seal;

an electric contact carried by and fixedly secured to the piston proximate a right end of the piston;

a plurality of axially spaced contacts carried by the right cylinder member and disposed in confronting relation to the right cylinder member bore for selective coaction with the piston contact in response to axial movement of the piston in the right cylinder member bore; and a plurality of electrical leads connected to the respective cylinder contacts and extending to locations external to the right cylinder member for providing respective electrical control signals generated in response to selective closing of the cylinder contacts by the piston contact.

16. A pressure cylinder apparatus comprising:

a hydraulic cylinder assembly including a left cylinder member, having a generally closed left end and defining a rightwardly opening socket at its right end, and a right cylinder member telescopically received at a left end thereof in the socket of the left cylinder member, coacting at its left end with the left cylinder member to define an annular inwardly opening groove, and defining a bore;

an annular seal received in the annular groove;

a piston slidably received in the right cylinder member bore and wipingly engaging the annular seal;

an electric contact carried by the piston proximate a right end of the piston;

a plurality of axially spaced contacts carried by the right cylinder member and disposed in confronting relation to the right cylinder member bore for selective coaction with the piston contact in response to axial movement of the piston in the right cylinder member bore; and a plurality of electrical leads connected to the respective cylinder contacts and extending to locations external to the right cylinder member for providing respective electrical control signals generated in response to selective closing of the cylinder contacts by the piston contact;

the right cylinder member defining an axially extending slot opening at a right end of the right cylinder member; and the axially spaced contacts and electrical leads being carried by a cartridge fitted in the slot of the right cylinder member.

17. A pressure cylinder apparatus comprising a hydraulic cylinder structure having a cylindrical wall defining a generally closed left end and a generally open right end; a piston movable axially within the hollow of the cylinder structure; a seal structure between the piston and the cylinder structure defining a fluid pressure chamber within the cylinder structure on the left side of the piston and an unpressurized chamber on the right side of the piston; a fluid pressure fitting communicating with the pressure chamber for connection to a fluid pressure conduit communicating with a coacting fluid pressure device; and a piston rod extending through the open end of the cylinder structure and into the unpressurized chamber for connection to the right side of the piston; characterized in that:

the apparatus includes a piston contact carried by the piston at a location on the piston to the right of the seal structure and within the unpressurized chamber;

a plurality of axially spaced cylinder contacts are disposed at an interior surface of the cylinder structure within the unpressurized chamber for selective coaction with the piston contact in response to axial movement of the piston in the hollow of the cylinder structure; and a plurality of electrical leads are connected to the respective cylinder contacts and extend to locations external to the cylinder structure for providing respective electrical control signals generated in response to selective closing of the cylinder contacts by the piston contact;

the cylinder structure comprising a compound structure constituted by a left cylinder structure defining the pressure chamber and a right cylinder structure coupled to the left cylinder structure and carrying a plurality of axially spaced cylinder contacts;

the right cylinder structure comprising a compound structure constituted by a cartridge and a right cylinder member having a cylindrical wall having an open right end and including an axially extending slot opening into the hollow interior of the right cylinder member and opening up the right end of the right cylinder member;

the cartridge being sized to fit in the slot;

the axially spaced cylinder contacts being provided on an inner surface of the cartridge;

the electric leads being carried by the cartridge;

the pressure cylinder apparatus comprising a hydraulic master cylinder assembly for transmitting pressurized fluid to a slave cylinder for controlling a motor vehicle function.

18. A pressure cylinder apparatus according to claim 17 wherein the motor vehicle function comprises engagement and disengagement of a motor vehicle clutch.

* * * * *